US007459258B2

(12) United States Patent
Chung et al.

(10) Patent No.: US 7,459,258 B2
(45) Date of Patent: Dec. 2, 2008

(54) TONER PROCESSES

(75) Inventors: Joo T. Chung, Webster, NY (US); Chieh-Min Cheng, Rochester, NY (US); Hui Chang, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 411 days.

(21) Appl. No.: 11/155,452

(22) Filed: Jun. 17, 2005

(65) Prior Publication Data

US 2006/0286478 A1 Dec. 21, 2006

(51) Int. Cl.
*G03G 9/08* (2006.01)

(52) U.S. Cl. ..... 430/137.14

(58) Field of Classification Search ..... 430/109.1, 430/137.14, 109.31, 109.3
See application file for complete search history.

(56) References Cited

U.S. PATENT DOCUMENTS 3,590,000 A 6/1971 Andersen
3,655,374 A 4/1972 Palermiti
3,720,617 A 3/1973 Cnatterji
3,729,178 A 4/1973 Stade
3,944,493 A 3/1976 Jadwin et al.
3,983,045 A 9/1976 Jugle et al.
4,007,293 A 2/1977 Mincer et al.
4,079,014 A 3/1978 Burness et al.
4,265,990 A 5/1981 Stolka et al.
4,394,430 A 7/1983 Jadwin et al.
4,560,635 A 12/1985 Hoffend et al.
4,563,408 A 1/1986 Lin et al.
4,584,253 A 4/1986 Lin et al.
4,858,884 A 8/1989 Harwath
4,935,326 A 6/1990 Creatura et al.
4,937,166 A 6/1990 Creatura et al.
5,227,460 A 7/1993 Mahabadi et al.
5,278,020 A 1/1994 Grushkin et al.
5,290,654 A 3/1994 Sacripante et al.
5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Adamski et al.
5,405,728 A 4/1995 Hopper et al.
5,418,108 A 5/1995 Kmiecik-Lawrynowicz et al.
5,496,676 A 3/1996 Croucher et al.
5,500,324 A * 3/1996 Mahabadi et al. ..... 430/137.15
5,501,935 A 3/1996 Patel et al.
5,527,658 A 6/1996 Hopper et al.
5,585,215 A 12/1996 Ong et al.
5,650,255 A 7/1997 Ng et al.
5,650,256 A 7/1997 Veregin et al.
5,723,253 A 3/1998 Higashino et al.
5,744,520 A 4/1998 Kmiecik-Lawrynowicz et al.
5,747,215 A 5/1998 Ong et al.
5,750,909 A * 5/1998 Hawkins et al. ..... 73/866
5,763,133 A 6/1998 Ong et al.
5,766,817 A 6/1998 Cheng et al.
5,804,349 A 9/1998 Ong et al.

(Continued)

*Primary Examiner*—John L Goodrow
(74) *Attorney, Agent, or Firm*—Carter, DeLuca, Farrell & Schmidt, LLP

(57) ABSTRACT

Processes for continuously forming latex emulsions and preparing toners with said emulsions are provided.

19 Claims, 2 Drawing Sheets

U.S. PATENT DOCUMENTS 5,827,633 A 10/1998 Ong et al.
5,840,462 A 11/1998 Foucher et al.
5,853,944 A 12/1998 Foucher et al.
5,863,698 A 1/1999 Patel et al.
5,869,215 A 2/1999 Ong et al.
5,902,710 A 5/1999 Ong et al.
5,910,387 A 6/1999 Mychajlowskij et al.
5,916,725 A 6/1999 Patel et al.
5,919,595 A 7/1999 Mychajlowskij et al.
5,925,488 A 7/1999 Patel et al.
5,977,210 A 11/1999 Patel et al.
6,004,714 A 12/1999 Ciccarelli et al.
6,054,240 A * 4/2000 Julien et al. ..... 430/109.3
6,190,815 B1 2/2001 Ciccarelli et al.
6,503,680 B1 * 1/2003 Chen et al. ..... 430/137.14

* cited by examiner

TONER PROCESSES

BACKGROUND

This disclosure relates to processes for preparing toner compositions. More specifically, continuous processes for emulsion polymerization, aggregation, coalescence, washing and wet sieving are described. These processes can be used to produce toner compositions.

Processes for forming toner compositions for use with electrostatographic, electrophotographic, or xerographic print or copy devices have been previously disclosed. For example, toners can be prepared by a process that involves emulsion preparation, followed by aggregation and coalescence of the emulsion, washing the resulting product and then isolating the toner. Such processes for the preparation of toners are illustrated in a number of patents, such as U.S. Pat. Nos. 5,290,654; 5,278,020; 5,308,734; 5,370,963; 5,344,738; 5,403,693; 5,418,108; 5,364,729; 5,346,797; 5,348,832; 5,405,728; 5,366,841; 5,496,676; 5,527,658; 5,585,215; 5,650,255; 5,650,256; 5,501,935; 5,723,253; 5,744,520; 5,763,133; 5,766,817; 5,747,215; 5,827,633; 5,853,944; 5,804,349; 5,840,462; 5,869,215; 5,863,698; 5,902,710; 5,910,387; 5,916,725; 5,919,595; 5,925,488 and 5,977,210, the entire disclosures of each of which are incorporated herein by this reference.

Currently, one or all of the emulsion, aggregation, coalescing, washing and isolation processes are performed in a batch mode. Accordingly, because each individual batch process involves the handling of bulk amounts of material, each process takes many hours to complete before moving to the next process. In addition, batch-to-batch consistency is frequently difficult to achieve because of variations that may arise from one batch to another.

It would be advantageous to provide a process for the preparation of toner that is more efficient, takes less time, and results in a consistent toner product.

SUMMARY

The present disclosure provides continuous emulsion polymerization processes for the production of a latex emulsion which, in embodiments, may be combined with a colorant in a continuous aggregation, coalescence and washing process.

The processes include producing toner in a single reaction vessel having an aggregation zone, a coalescence zone and a washing zone, by aggregating a colorant and latex emulsion to form aggregated toner particles in an aggregation zone of the single reaction vessel, coalescing the aggregated toner particles in a coalescence zone of the single reaction vessel, and washing the aggregated and coalesced toner particles in a washing zone of the single reaction vessel, thereby forming toner. In embodiments, the single reaction vessel may be a multi-screw extruder.

The processes also include, in embodiments, preparing an emulsion comprising at least one monomer, water, an optional surfactant and an optional seed resin in a single reaction vessel, maintaining the emulsion under polymerization conditions to provide a latex emulsion containing latex particles, and continuously recovering the latex emulsion.

Processes are also provided which include preparing an emulsion comprising at least one monomer, water, an optional surfactant and an optional seed resin in a single reaction vessel, maintaining the emulsion under polymerization conditions to provide a latex emulsion containing latex particles, continuously recovering the latex emulsion, contacting the latex emulsion and a colorant, aggregating the colorant and latex emulsion to form aggregated toner particles, coalescing the aggregated toner particles, and washing the aggregated and coalesced toner particles, by sequentially advancing the colorant and latex emulsion through a multi-screw extruder defining an aggregation zone, a coalescence zone and a washing zone.

BRIEF DESCRIPTION OF THE DRAWINGS

Various embodiments of the present disclosure will be described herein below with reference to the figures wherein.

EMBODIMENTS

Processes for making toner compositions in accordance with this disclosure include a continuous emulsion polymerization process (schematically illustrated in FIG. 1) to provide a latex emulsion followed by a continuous aggregation/coalescence/washing process (schematically illustrated in FIG. 2) to provide a toner composition.

Figure 1:
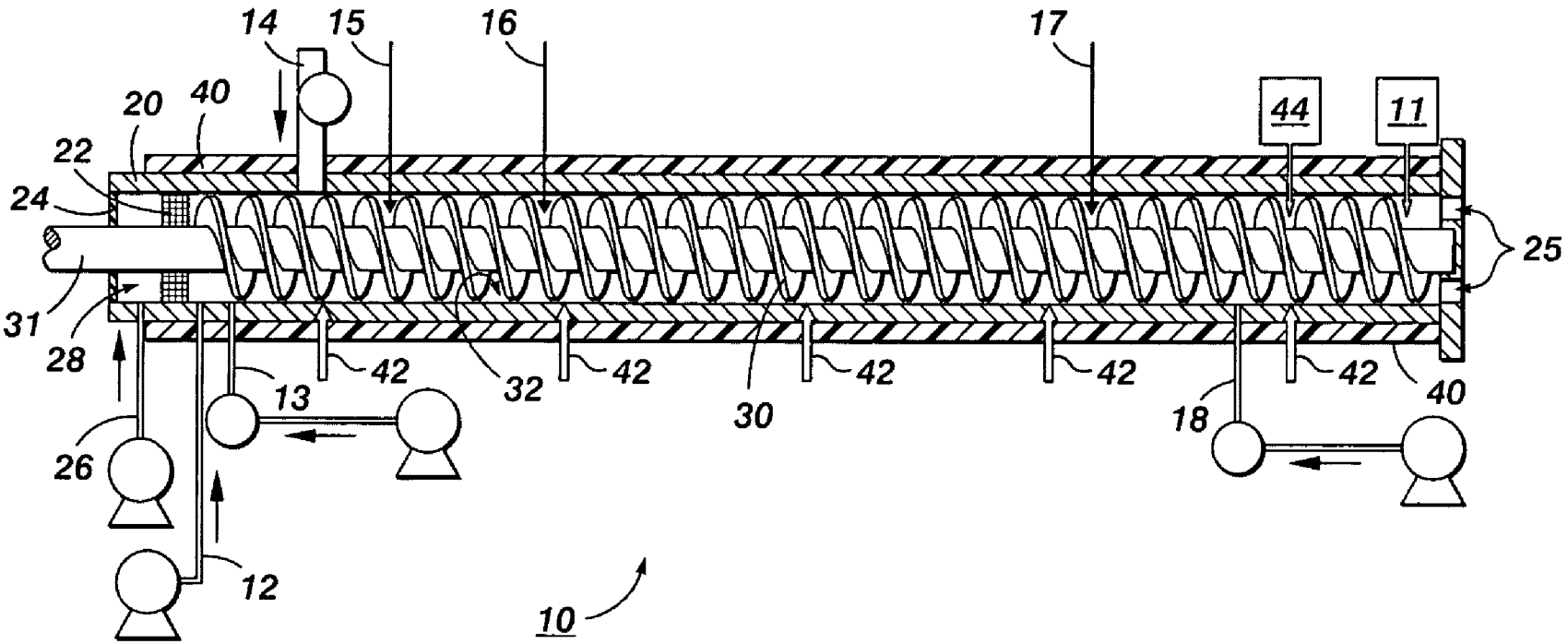
FIG. 1 schematically shows an apparatus suitable for use in connection with a continuous emulsion polymerization process in accordance with embodiments of the present disclosure.

Turning to FIG. 1, a screw extruder apparatus 10 includes an extruder barrel 20, a screw 30, a screw extruder channel 32, a heating/cooling system 40, thermocouples 42, an inert gas supply port 11, a water supply port 12, a surfactant supply port 13, a monomer supply port 14, a seed resin supply port 15, an initiator supply port 16, a pH titration agent supply port 17, a stabilizer supply port 18. Screw 30 is driven by shaft 31 which is connected to a drive motor (not shown) in a conventional manner that allows for rotation of screw 30 at speeds of from about 50 rotations per minute ("rpm") to about 1500 rpm in embodiments from about 250 rpm to about 1000 rpm.

Shaft 31 passes through seal 24, liquid seal housing 28, and blister ring 22, which seal the upstream end of barrel 20. Seal fluid is supplied to liquid seal housing 28 through seal fluid supply port 26. Screw 30 can advantageously be modular in construction in the form of pieces of elements, enabling the screw to be configured with different conveying elements and kneading elements having the appropriate lengths, pitch angles, and the like, in such a way as to provide optimum conveying, mixing, dispersing, devolatilizing, discharging, and pumping conditions. Thermocouples 42 along the barrel monitor the temperature of barrel 20 and controls barrel 20 temperature to maintain a desired temperature suitable for the polymerization reaction. Suitable temperatures are from about 45° C. to about 90° C. and, in embodiments, from about 55° C. to about 85° C.

In embodiments, barrel 20 may be segmented into about 10 to about 12 sections. Local temperature control may be achieved by independently controlling the temperature in each segment of the barrel.

To provide an oxygen-free environment within barrel 20 suitable for emulsion polymerization, an inert gas such as nitrogen is supplied to the interior of barrel 20 via inert gas supply port 11 located near the downstream end of barrel 20. Deionized water is introduced into barrel 20 via water supply port 12 which can be located just before the screw 30. Deionized water can be used to avoid ions interfering with the polymerization reaction. It should be understood that the water used can be purified to any desired degree using conventional methods (for example, osmotic processes, filtration, and the like). Water can be pumped into barrel 20 at a controlled pressure of from about 100 psi to about 1000 psi, in embodiments from about 250 psi to about 750 psi via a pump right after liquid seal housing 28, which is designed to avoid upstream flow of the reaction mixture. A surfactant is introduced into barrel 20 via surfactant supply port 13 downstream of water supply port 12, but upstream of monomer supply port 14.

The amount of surfactant can be from about 0.01 to about 15 percent by weight of the final emulsion composition and, in embodiments, from about 0.1 to about 5 percent by weight of the final emulsion composition. Monomer is supplied to barrel 20 via monomer supply port 14. Monomer may be introduced at a pressure, which matches the pressure at which water is introduced into barrel 20. The amount of monomer can be from about 1 to about 65 percent by weight of the final emulsion composition, in embodiments from about 10 to about 50 percent by weight of the final emulsion composition. Seed resin is introduced into barrel 20 via seed resin supply port 15. The amount of seed resin can be from about 0.1 to about 25 percent by weight of the final emulsion composition, in embodiments of from about 5 to about 20 percent by weight of the final emulsion composition.

In embodiments, two or more of the water, surfactant, monomer and seed resin may be pre-mixed prior to introduction into the barrel. For example, the surfactant may be pre-mixed with water and introduced into the barrel simultaneously with water. As another example, seed resin may be pre-mixed with monomer and introduced into the barrel simultaneously with the monomer. Any other suitable combinations may be utilized. Additionally, at least one monomer may be utilized in forming the resin; in embodiments from about 2 to about 10 monomers may be utilized.

Once the water, surfactant, monomer and seed resin are mixed in the nitrogen atmosphere and heated to a desired temperature, initiator is introduced into barrel 20 via initiator supply port 16 to start the polymerization reaction. Initiator supply port 16 is located sufficiently downstream of the seed resin supply port 15 to ensure adequate mixing of the water, surfactant, monomer and seed resin before the introduction of the initiator. The amount of initiator can be from about 0.1 to about 8 percent by weight of the final emulsion composition, in embodiments from about 2 to about 6 percent by weight of the final emulsion composition.

The reaction time for the emulsion polymerization can be controlled by amount of initiator, screw design, screw speed, feed rates, temperature and pressure. The reaction time needed for emulsion polymerization will vary depending on a number of factors including the particular monomer employed, the temperature within the barrel and the particular initiator chosen. The screw extruder should be designed to provide residence times of from about 0.5 minutes to about 10 minutes, and in embodiments of from about 2 minutes to about 8 minutes.

The pH of the latex emulsion can be adjusted by the introduction of a pH titration agent via pH titration agent supply port 17. The amount of pH titration agent introduced can be determined and adjusted automatically in response to pH reading from pH meter 44. The pH may be adjusted to from about 1 to about 5, in embodiments from about 2 to about 4, depending on factors such as the particular monomer employed, the particular initiator chosen and the final desired toner composition.

A stabilizer can be introduced into barrel 20 via stabilizer supply port 18 to stabilize the emulsion. The amount of stabilizer can be from about 0.1 to about 10 percent by weight of the final emulsion composition in embodiments from about 2 to about 8 percent by weight of the final emulsion composition.

The resulting emulsion (which includes, in embodiments, "latex") exits barrel 20 via opening 25 and may be introduced directly into a second screw extruder 100 (see FIG. 2) where a continuous aggregation/coalescence/washing process occurs.

Figure 2:
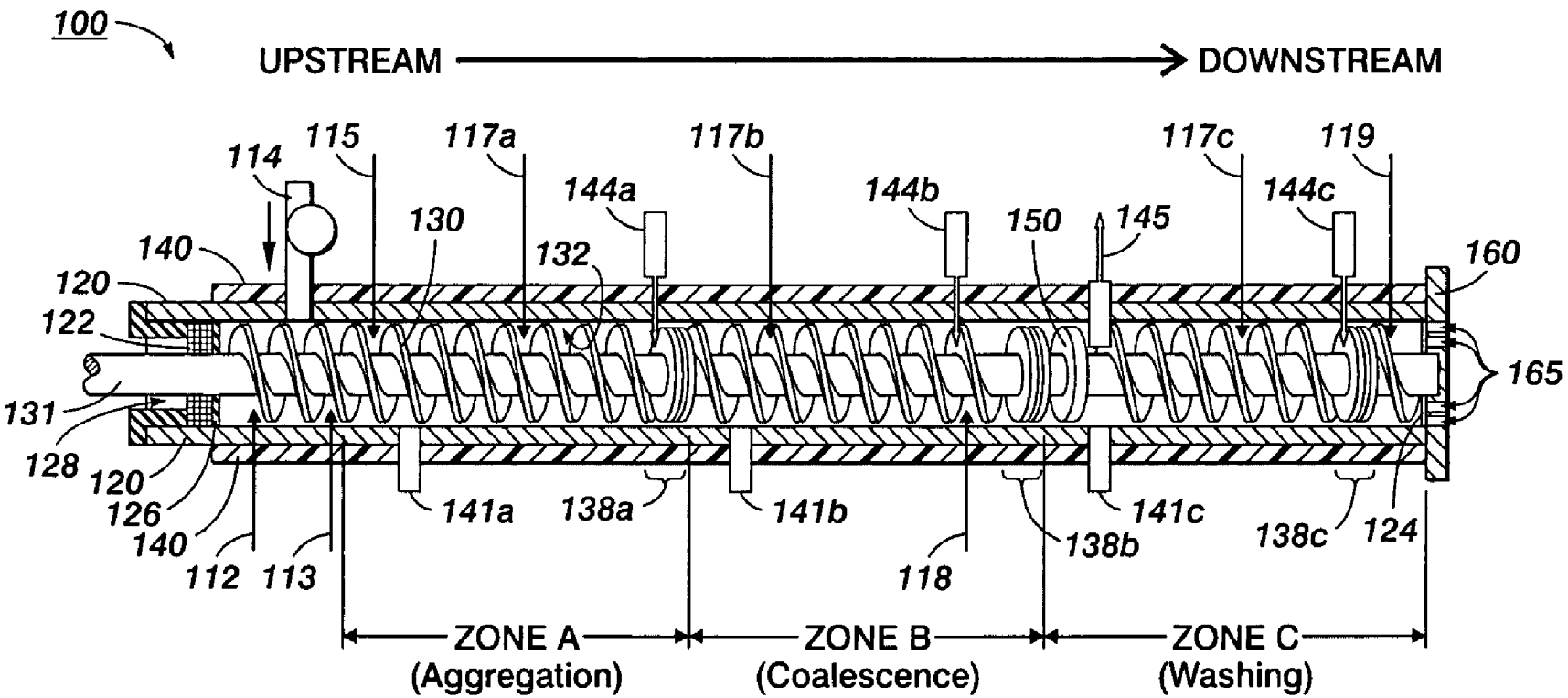
FIG. 2 schematically shows an apparatus suitable for use in connection with continuous aggregation, coalescence and washing processes in accordance with embodiments of the present disclosure.

Referring now to FIG. 2, screw extruder apparatus 100 includes an extruder barrel 120, a screw 130, a screw extruder channel 132, a heater 140, thermocouple 141, a water supply port 112, a surfactant/colorant supply port 113, and a latex supply port 114. Screw 130 is driven by shaft 131 which is connected to a drive motor (not shown) in a conventional manner that allows for rotation of screw 130 at speeds of from about 50 rotations per minute ("rpm") to about 2000 rpm, in embodiments from about 250 rpm to about 1250 rpm. Shaft 131 passes through liquid seal housing 128, blister ring 122 and seal pack 126, which seals the upstream end of barrel 120.

Screw extruder apparatus 100 defines three zones; namely Zone A where aggregation takes place, Zone B where coalescence takes place, and Zone C where washing takes place. Each zone includes a pH meter 144*a*, 144*b*, 144*c* and a pH titration agent supply port 117*a*, 117*b*, 117*c*. Each zone also includes a thermocouple 141*a*, 141*b*, 141*c* which controls and monitors the temperature of barrel 120 to maintain a desired temperature in each zone that is suitable for each of the aggregation/coalescence/washing processes. Material moves from the upstream end of apparatus 100 in the downstream direction sequentially through Zones A, B and C, eventually passing through mesh 124 and exiting apparatus 100 through openings 165 of head 160.

Screw 130 can be modular in construction in the form of pieces of elements, enabling the screw to be configured with different conveying elements and kneading elements having the appropriate lengths, pitch angles, and the like, in such a way as to provide optimum conveying, mixing, dispersing, devolatilizing, discharging, and pumping conditions. For example, lengths of from about 1350 mm to about 3000 mm, in embodiments from about 1500 mm to about 2500 mm, and pitch angles of from about 0° to about 90°, in embodiments from about 20° to about 75°, may be utilized.

The local residence time in each of Zones A, B and C can be controlled by screw design, screw speed, feed rates, temperature and pressure. The local residence time suitable for the aggregation/coalescence/washing processes will vary depending on a number of factors including, for example, the particular latex employed, the temperature within the barrel and the particular aggregation agent chosen. The screw extruder should be designed to provide local residence times of from about 1 minute to about 5 minutes in Zone A, in embodiments from about 2 minutes to about 4 minutes in Zone A; from about 0.5 minutes to about 2 minutes in Zone B, in embodiments from about 1 minute to about 1.5 minutes in Zone B; and from about 1 minute to about 5 minutes in Zone C, in embodiments from about 2 minutes to about 4 minutes in Zone C.

Water is introduced into barrel 120 via water supply port 112 which can be located just before the emulsion feed port 114. In embodiments, deionized water can be used to avoid ions interfering with the aggregation/coalescence/washing processes. It should be understood that the water used can be purified to any desired degree using conventional methods (for example, osmotic processes, filtration, and the like). Water can be pumped into barrel 120 at a controlled pressure of from about 100 psi to about 1000 psi, in embodiments from about 250 psi to about 750 psi, via a pump located right after liquid seal housing (not shown), which designed to avoid upstream flow of the composition being subjected to the aggregation/coalescence/washing processes.

A surfactant and a colorant can be introduced into barrel 120 downstream of water supply port 112 via surfactant supply port 113. The surfactant/colorant mixture can be pumped into barrel 120 via a pump (not shown) at a controlled pressure of from about 100 psi to about 1000 psi, in embodiments from about 250 psi to about 750 psi. The amount of surfactant can be from about 0.01 to about 15 percent by weight of the final toner composition and, in embodiments, from about 0.1 to about 5 percent by weight of the final toner composition. The amount of colorant can be from about 1 to about 15 percent by weight of the final toner composition and, in embodiments from about 3 to about 10 percent by weight of the final toner composition. Latex exiting from the apparatus shown in FIG. 1 is introduced into screw extruder 100 via emulsion supply port 114, which is located at approximately the same position as the surfactant supply port 113. Latex may be introduced at a pressure, which matches the pressure at which water is introduced into barrel 120. The amount of polymer resin can be from about 65 to about 96 percent by weight of the final toner composition and, in embodiments, from about 75 to about 90 percent by weight of the final toner composition.

In embodiments, two or more of the water, surfactant, colorant and latex may be pre-mixed prior to introduction into the barrel. For example, as illustrated in FIG. 2, the surfactant may be pre-mixed with colorant and the two ingredients introduced into the barrel simultaneously. Similarly, the surfactant and/or the colorant may be pre-mixed with water and the ingredients may be introduced into the barrel simultaneously. The surfactant and/or the colorant may also be pre-mixed with the latex and thus those ingredients may be introduced into the barrel simultaneously. Any other suitable combinations may be utilized.

The aggregation process is started by introducing an aggregating agent into barrel 120 via aggregating agent supply port 115, which marks the beginning of Zone A. An aggregating agent may be used to optimize particle aggregation time while minimizing fouling and coarse particle formation. The amount of aggregating agent can be from about 0.01 to about 5 percent by weight of the final toner composition and, in embodiments, from about 0.05 to about 3 percent by weight of the final toner composition. Screw 130 downstream of aggregating agent supply port 115 may be configured to have right hand kneading blocks and neutral kneading blocks to promote both mixing and conveying of material. A left hand kneading block can be placed on screw 130 at the downstream end of the aggregation zone 138*a* (Zone A) to increase local residence time.

The pH during the aggregation process can be adjusted by the introduction of a pH titration agent via pH titration agent supply port 117*a*. The amount of pH titration agent introduced can be determined and adjusted automatically in response to a pH reading from pH meter 144*a*. The pH of Zone A may be adjusted to from about 2.5 to about 7, in embodiments from about 4 to about 6. The temperature during the aggregation process can be monitored by thermocouple 141*a* and heater 140 adjusted. The temperature of Zone A may be adjusted to from about 20° C. to about 50° C., in embodiments from about 30° C. to about 40° C.

Aggregated latex in accordance with the present disclosure refers, in embodiments, for example, aggregated toner particles having a diameter from about 1μ to about 20μ, in embodiments from about 3μ to about 15μ.

Coalescence occurs by mixing and kneading the aggregated emulsion at an elevated temperature in Zone B. As with the aggregation zone, screw 130 in the coalescence zone can also be configured to have right hand and neutral kneading blocks. A left hand kneading block can be placed on screw 130 at the downstream end of the coalescence zone 138*b* (Zone B) to increase local residence time. A stabilizer can be introduced into barrel 120 via stabilizer supply port 118 to stabilize the suspension resulting from aggregation and coalescence of the latex. The amount of stabilizer can be from about 0.1 to about 10 percent by weight of the final toner composition and, in embodiments, from about 0.5 to about 3 percent by weight of the final toner composition.

The pH during the coalescence process can be adjusted by the introduction of a pH titration agent via pH titration agent supply port 117*b*. The amount of pH titration agent introduced can be determined and adjusted automatically in response to pH reading from pH meter 144*b*. The pH of Zone B may be adjusted to from about 3.5 to about 10, in embodiments from about 5 to about 7. The barrel temperature during the coalescence process can be controlled and monitored by thermocouple 141*b*. The temperature of Zone B may be adjusted to from about 70° C. to about 98° C., in embodiments from about 75° C. to about 90° C.

Aggregated and coalesced toner particles in accordance with the present disclosure refer, in embodiments, for example to particles of toner having a diameter from about 1μ to about 20μ, in embodiments from about 3μ to about 15μ.

Once coalescence is complete, washing is achieved in Zone C as a counter current process. Cylinder ring 150 is placed at the downstream end of the coalescence zone (Zone B) to create a sudden pressure drop so that screw 130 at the beginning of Zone C is starved of material. Water (for example, deionized water) is introduced at the downstream end of Zone C via downstream water supply port 119. Water can be pumped into barrel 120 at a controlled pressure of from about 100 psi to about 1000 psi, in embodiments from about 250 psi to about 750 psi via a pump (not shown) to create the counter flow of water upstream. Narrow pitch conveying screws (not shown) may be placed near the downstream end 138*c* of zone C before head 160. These narrow screws, in combination with the small exit openings 165, assist in creating back pressure. A left hand kneading block can also be provided near the downstream end 138*c* of the washing zone. The water can be separated from the toner and removed through a twin screw mechanical vent 145 that is fitted with a mechanical filter (not shown).

The pH during the washing process can be adjusted by the introduction of a pH titration agent via pH titration agent supply port 117*c*. The amount of pH titration agent introduced can be determined and adjusted automatically in response to pH reading from pH meter 144*c*. The pH of Zone C may be adjusted to from about 3 to about 9, in embodiments from about 5 to about 7.

The temperature during the washing process can be controlled and monitored by thermocouple 141*c*. The temperature of Zone C may be adjusted to from about 20° C. to about 65° C., in embodiments from about 35° C. to about 50° C.

Large particle filtration may be achieved by a screen 124 placed at the downstream end of Zone C. Suitable mesh sizes are from about 10 μm to about 50 μm, in embodiments from about 20 μm to about 40 μm. This filtration step may replace wet sieve processes used in prior batch toner preparation processes.

Any monomer suitable for preparing a latex emulsion can be used in the present processes. Suitable monomers useful in forming the latex emulsion, and thus the resulting latex particles in the latex emulsion include, but are not limited to, styrenes, acrylates, methacrylates, butadienes, isoprenes, acrylic acids, methacrylic acids, acrylonitriles, mixtures thereof, and the like. The particular seed resin employed may be selected depending upon the particular latex polymer to be made in the emulsion polymerization process.

Illustrative examples of specific latex resin, polymer or polymers that can be prepared as latex particles in the continuous emulsion polymerization process in accordance with the present disclosure include styrene acrylates, styrene butadienes, styrene methacrylates, and more specifically, poly (styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly (styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), and poly(acrylonitrile-butyl acrylate-acrylic acid). In addition, polyester resins obtained from the reaction of bisphenol A and propylene oxide or propylene carbonate, and in particular including such polyesters followed by the reaction of the resulting product with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol may also be used.

In embodiments, an amorphous polyester resin, for example a polypropoxylated bisphenol A fumarate polyester, may be prepared in the continuous process of the present disclosure and then utilized to form a toner composition. Bisphenol A, propylene oxide or propylene carbonate and fumaric acid would be utilized as monomeric components in the process of the present disclosure while a propoxylated bisphenol A fumarate would be utilized as seed resin. A linear propoxylated bisphenol A fumarate resin which may be utilized as a seed resin is available under the trade name SPARII from Resana S/A Industrias Quimicas, Sao Paulo Brazil. Other propoxylated bisphenol a fumarate resins that are commercially available include GTUF and FPESL-2 from Kao Corporation, Japan, and EM181635 from Reichhold, Research Triangle Park, North Carolina and the like.

The latex polymer particles may be present in the toner compositions of the present disclosure in amounts from about 75 weight percent to about 98 weight percent, in embodiments from about 85 weight percent to about 96 weight percent of the toner components. The size of the latex polymer particles of the present disclosure can be, for example, from about 0.05 microns to about 1 micron in volume average diameter, in embodiments from about 0.1 microns to about 0.75 microns in volume average diameter, as measured by a Brookhaven nanosize particle analyzer. Other sizes and effective amounts of latex polymer may be selected in embodiments.

Examples of initiators for the latex preparations include water soluble initiators, such as ammonium and potassium persulfates, and organic soluble initiators including peroxides and hydroperoxides including Vazo peroxides, such as VAZO 64™, 2-methyl 2-2'-azobis propanenitrile, VAZO 88™, and 2-2'-azobis isobutyramide dehydrate and mixtures thereof. In embodiments chain transfer agents may be utilized including dodecane thiol, octane thiol, carbon tetrabromide, mixtures thereof, and the like in amounts from about 0.1 to about 10 percent and in embodiments from about 0.2 to about 5 percent by weight of monomer, to control the molecular weight properties of the polymer when emulsion polymerization is conducted in accordance with the present disclosure.

Surfactants for the preparation of latexes and colorant dispersions in the present continuous processes can be ionic or nonionic surfactants. Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Kao, mixtures thereof, and the like.

Examples of nonionic surfactants include, but are not limited to alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, mixtures thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be selected.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, and C12, C15, C17 trimethyl ammonium bromides, mixtures thereof, and the like. Other cationic surfactants include cetyl pyridinium bromide, halide salts of quaternized polyoxyethylalkylamines, dodecylbenzyl triethyl ammonium chloride, and the like, and mixtures thereof. The choice of particular surfactants or combinations thereof as well as the amounts of each to be used are within the purview of those skilled in the art.

Colorants useful in the present continuous processes include pigments, dyes, mixtures of pigment and dyes, mixtures of pigments, mixtures of dyes, and the like. Suitable colorants are known, are available from a variety of commercial sources, and include, but are not limited to, black pigments such as carbon black. Generally, colored pigments that can be selected are cyan, magenta, red, brown, orange or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be used include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. Mixtures of the foregoing may be utilized in embodiments.

The pH titration agent utilized in the processes of the present disclosure can be any acid or base that does not adversely affect the products being produced. Suitable bases can include metal hydroxides, such as sodium hydroxide, potassium hydroxide, ammonium hydroxide, and optionally mixtures thereof. Suitable acids include nitric acid, sulfuric acid, hydrochloric acid, citric acid, acetic acid, and optionally mixtures thereof.

Any aggregating agent capable of causing complexation might be used in the continuous processes of the present disclosure. Both alkali earth metal or transition metal salts can be utilized as aggregating agents. In embodiments, alkali (II) salts can be selected to aggregate sodio sulfonated polyester colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally mixtures thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, mixtures thereof, and the like.

Stabilizers that may be utilized in the present continuous processes include bases such as metal hydroxides, including sodium hydroxide, potassium hydroxide, ammonium hydroxide, and optionally mixtures thereof. Also useful as a stabilizer is a composition containing sodium silicate dissolved in sodium hydroxide.

In order to aid in the processing of the toner composition, an ionic coagulant having an opposite polarity to the ionic surfactant in the latex (i.e., a counterionic coagulant) may optionally be used in the toner composition. The quantity of coagulant is present to, for example, prevent/minimize the appearance of fines in the final slurry. Fines refers, in embodiments, for example, to small sized particles of less than about 6 microns in average volume diameter, in embodiments from about 2 microns to about 5 microns in average volume diameter, which fines can adversely affect toner yield. Counterionic coagulants may be organic or inorganic entities. Exemplary coagulants that can be included in the toner include polymetal halides, polymetal sulfosilicates, monovalent, divalent or multivalent salts optionally in combination with cationic surfactants, mixtures thereof, and the like. Inorganic cationic coagulants include, for example, polyaluminum chloride (PAC), polyaluminum sulfo silicate (PASS), aluminum sulfate, zinc sulfate, or magnesium sulfate. For example, in embodiments the ionic surfactant of the resin latex dispersion can be an anionic surfactant, and the counterionic coagulant can be a polymetal halide or a polymetal sulfo silicate. When present, the coagulant is used in an amount from about 0.02 to about 2 percent by weight of the total toner composition, in embodiments from about 0.1 to about 1.5 percent by weight of the total toner composition.

The toner may also include charge additives in effective amounts of, for example, from about 0.1 to about 5 weight percent, in embodiments from about 1 to about 3 weight percent. Suitable charge additives include alkyl pyridinium halides, bisulfates, the charge control additives of U.S. Pat. Nos. 3,944,493; 4,007,293; 4,079,014; 4,394,430 and 4,560,635, the entire disclosures of each of which are incorporated herein by reference, negative charge enhancing additives like aluminum complexes, any other charge additives, mixtures thereof, and the like.

Further optional additives include any additive to enhance the properties of toner compositions. Included are surface additives, color enhancers, etc. Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 2 weight percent in embodiments from about 0.5 to about 1.5 weight percent; reference, for example, U.S. Pat. Nos. 3,590,000; 3,720,617; 3,655,374 and 3,983,045, the entire disclosures of each of which are incorporated herein by reference. Particularly useful additives include zinc stearate and AEROSIL R972® available from Degussa. The coated silicas of U.S. Pat. Nos. 6,190,815 and 6,004,714, the entire disclosures of each of which are incorporated herein by reference, can also be selected in amounts, for example, of from about 0.1 to about 2 percent by weight, in embodiments from about 0.5 to about 1.5 percent by weight, which additives can be added during the aggregation or blended into the formed toner product.

Developer compositions can be prepared by mixing the toners obtained with the processes disclosed herein with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 2 percent by weight of the toner to about 8 percent by weight of the toner, in embodiments from about 4 percent by weight to about 6 percent by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, mixtures thereof and other known components.

Imaging methods are also envisioned with the toners disclosed herein. Such methods include, for example, some of the above patents mentioned above and U.S. Pat. Nos. 4,265,990, 4,858,884, 4,584,253 and 4,563,408, the entire disclosures of each of which are incorporated herein by reference. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

The following example illustrates embodiments of the present disclosure. The example is intended to be illustrative only and is not intended to limit the scope of the present disclosure. Also, parts and percentages are by weight unless otherwise indicated.

EXAMPLES

Example 1

A pre-blend of about 1.9% 0.02M HNO3, about 24.7% of a latex core including a styrene/n-butyl acrylate/β-carboxyethyl acrylate copolymer at a ratio of about 74:23:3, about 12.2% of a latex shell including a styrene/n-butyl acrylate/β-carboxyethyl acrylate copolymer at a ratio of about 74:23:3, about 6.7% Regal 330 carbon black and about 54.5% deionized water were injected into a twin-screw extruder (ZSK25 manufactured by Coperion) via a pressure pump for aggregation and coalescence. The length/diameter (L/D ratio) of the extruder was about 53 and the screw L/D was about 54.16. The screw configuration had a conveying screw followed by neutral kneading elements, right hand kneading elements, neutral kneading blocks, left hand kneading elements, and small pitch conveying elements to control stress, strain, residence time, and pumping of the pre-blend materials.

The feed rate was adjusted from about 48 g/min to about 97 g/min and temperature was from about 40° C. to about 100° C. Screw speed varied from about 200 to about 800 rpm. The size of the resin particles was measured using a FPIA2100 manufactured by Sysmex Corporation. Results demonstrated particle growth from an initial particle size of about 0.9 μm to about 2.53 μm. At a higher high screw speed and feed rate, better growth of particles was observed and the particles remained suspended.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A process for producing toner in a single reaction vessel comprising an aggregation zone, a coalescence zone and a washing zone, said process comprising:

aggregating a colorant and latex emulsion for a period of time of from about 1 minute to about 5 minutes to form aggregated toner particles in an aggregation zone of the single reaction vessel;

coalescing the aggregated toner particles for a period of time of from about 0.5 minutes to about 2 minutes in a coalescence zone of the single reaction vessel to form aggregated and coalesced toner particles; and washing the aggregated and coalesced toner particles for a period of time of from about 1 minute to about 5 minutes in a washing zone of the single reaction vessel, thereby forming toner.

2. A process as in claim 1 wherein the colorant and latex emulsion in the aggregation zone are at a temperature from about 20° C. to about 50° C. and a pH from about 2.5 to about 7, the aggregated toner particles in the coalescence zone are at a temperature from about 70° C. to about 98° C. and a pH from about 3.5 to about 10, and the aggregated and coalesced toner particles in the washing zone are at a temperature from about 20° C. to about 65° C. and a pH from about 3 to about 9.

3. A process as in claim 1 wherein the colorant and latex emulsion in the aggregation zone are at a temperature from about 30° C. to about 40° C. and a pH from about 4 to about 6, the aggregated toner particles in the coalescence zone are at a temperature from about 75° C. to about 90° C. and a pH from about 5 to about 7, and the aggregated and coalesced toner particles in the washing zone are at a temperature from about 35° C. to about 50° C. and a pH from about 5 to about 7.

4. A process as in claim 1 wherein the latex emulsion comprises latex particles selected from the group consisting of styrenes, acrylates, methacrylates, butadienes, isoprenes, acrylic acids, methacrylic acids, acrylonitriles, and optionally mixtures thereof, and particles comprising the aggregated and coalesced toner particles have a diameter from about 1μ to about 20μ.

5. A process as in claim 1 wherein the latex emulsion comprises latex particles selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly (styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), and poly(acrylonitrile-butyl acrylate-acrylic acid), and particles comprising the aggregated and coalesced toner particles have a diameter from about 3μ to about 15μ.

6. A process as in claim 1, wherein the colorant is selected from the group consisting of black pigments, cyan pigments, magenta pigments, red pigments, brown pigments, orange pigments yellow pigments, and mixtures thereof.

7. A process as in claim 1 wherein the colorant is selected from the group consisting of carbon black, 2,9-dimethyl-substituted quinacridone and anthraquinone dye, diazo dye, copper tetra(octadecyl sulfonamido) phthalocyanine, x-copper phthalocyanine pigment, anthrathrene blue, diarylide yellow 3,3-dichlorobenzidene acetoacetanilide, nitrophenyl amine sulfonamide, and 2,5-dimethoxy-4-sulfonanilide phenylazo-4'-chloro-2,5-dimethoxy acetoacetanilide and mixtures thereof.

8. A process as in claim 1 further comprising adding an aggregating agent selected from the group consisting of alkali earth metal salts and transition metal salts to the latex in the aggregation zone.

9. A process as in claim 8 wherein the aggregating agent is selected from the group consisting of beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, vanadium acetate, niobium acetate, tantalum acetate, chromium acetate, molybdenum acetate, tungsten acetate, manganese acetate, iron acetate, ruthenium acetate, cobalt acetate, nickel acetate, copper acetate, zinc acetate, cadmium acetate, silver acetate, vanadium acetoacetate, niobium acetoacetate, tantalum acetoacetate, chromium acetoacetate, molybdenum acetoacetate, tungsten acetoacetate, manganese acetoacetate, iron acetoacetate, ruthenium acetoacetate, cobalt acetoacetate, nickel acetoacetate, copper acetoacetate, zinc acetoacetate, cadmium acetoacetate, silver acetoacetate, vanadium sulfate, niobium sulfate, tantalum sulfate, chromium sulfate, molybdenum sulfate, tungsten sulfate, manganese sulfate, iron sulfate, ruthenium sulfate, cobalt sulfate, nickel sulfate, copper sulfate, zinc sulfate, cadmium sulfate, silver sulfate, aluminum acetate, polyaluminum chloride, and mixtures thereof.

10. A process as in claim 1 further comprising adding a metal hydroxide stabilizer selected from the group consisting of sodium hydroxide, potassium hydroxide, ammonium hydroxide, sodium silicate dissolved in sodium hydroxide, and mixtures thereof to the aggregated toner particles in the coalescence zone.

11. A process as in claim 1 wherein the single reaction vessel is a multi-screw extruder possessing a screw rotating at a speed of from about 50 rpm to about 2000 rpm, and wherein the latex is provided by a continuous emulsion polymerization process.

12. A process comprising:

preparing an emulsion comprising at least one monomer, water, an optional surfactant and an optional seed resin in a single reaction vessel;

maintaining the emulsion under polymerization conditions for a period of time of from about 0.5 minutes to about 10 minutes to provide a latex emulsion containing latex particles; and continuously recovering the latex emulsion.

13. A process as in claim 12, wherein the at least one monomer comprises from about 2to about 10 monomers, the at least one monomer is selected from the group consisting of styrenes, acrylates, methacrylates, butadienes, isoprenes, acrylic acids, methacrylic acids, and acrylonitriles, the optional seed resin comprises the latex particles being produced, and wherein the emulsion polymerization occurs at a temperature from about 45° C. to about 90° C. and a pH from about 1 to about 5.

14. A process as in claim 12, wherein the latex particles are selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly (styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), and poly(acrylonitrile-butyl acrylate-acrylic acid), and wherein the emulsion polymerization occurs at a temperature from about 55° C. to about 85° C. and a pH from about 2 to about 4.

15. A process as in claim 12 wherein the optional surfactant is selected from the group consisting of anionic sulfate surfactants, anionic sulfonate surfactants, anionic acid surfactants, nonionic alcohol surfactants, nonionic acid surfactants, nonionic ether surfactants, cationic ammonium surfactants, and cationic halide salts of quaternized polyoxyethylalkylamine surfactants.

16. A process as in claim 15 wherein the optional surfactant is selected from the group consisting of sodium dodecylsulfate, sodium dodecylbenzene sulfonates, sodium dodecyinaphthalene sulfate, dialkyl benzenealkyl sulfates, dialkyl benzenealkyl sulfonates, abitic acid, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octyiphenyl ether, polyoxyethylene oleyl ether, polyoxyethylene sorbitan monolaurate, polyoxyethylene stearyl ether, polyoxyethylene nonylphenyl ether, dialkyiphenoxy poly(ethyleneoxy) ethanol, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12 trimethyl ammonium bromide, C15 trimethyl ammonium bromide, C17 trimethyl ammonium bromide, dodecylbenzyl triethyl ammonium chloride, cetyl pyridinium bromide, and optionally mixtures thereof.

17. A process as in claim 12, wherein the at least one monomer comprises bisphenol A, propylene oxide and fumaric acid and the seed resin comprises a propoxylated bisphenol A fumarate, and wherein the single reaction vessel is a multi-screw extruder.

18. A process comprising preparing an emulsion comprising at least one monomer, water, an optional surfactant and an optional seed resin in a single reaction vessel;

maintaining the emulsion under polymerization conditions to provide a latex emulsion containing latex particles;

continuously recovering the latex emulsion;

contacting the latex emulsion and a colorant;

aggregating the colorant and latex emulsion to form aggregated toner particles, coalescing the aggregated toner particles, and washing the aggregated and coalesced toner particles by sequentially advancing the colorant and latex emulsion through a multi-screw extruder defining an aggregation zone for a period of time of from about 1 minute to about 5 minutes, a coalescence zone for a period of time of from about 0.5 minutes to about 2 minutes, and a washing zone for a period of time of from about 1 minute to about 5 minutes.

19. A process as in claim 18 wherein particles comprising the toner particles have a diameter from about 1μ to about 20μ and the single reaction vessel is a multi-screw extruder possessing a screw rotating at a speed of from about 50 rpm to about 2000 rpm.

* * * * *